US008900380B2

(12) United States Patent
Teraoka et al.

(10) Patent No.: US 8,900,380 B2
(45) Date of Patent: Dec. 2, 2014

(54) LOW-CHROMIUM STAINLESS STEEL EXCELLENT IN CORROSION RESISTANCE OF WELD

(75) Inventors: Shinichi Teraoka, Tokyo (JP); Shunji Sakamoto, Tokyo (JP); Masuhiro Fukaya, Tokyo (JP)

(73) Assignee: Nippon Steel & Sumikin Stainless Steel Corporation, Tokyo (JP)

( * ) Notice: Subject to any disclaimer, the term of this patent is extended or adjusted under 35 U.S.C. 154(b) by 175 days.

(21) Appl. No.: 13/580,850

(22) PCT Filed: Feb. 21, 2011

(86) PCT No.: PCT/JP2011/054409

§ 371 (c)(1),
(2), (4) Date: Aug. 23, 2012

(87) PCT Pub. No.: WO2011/105591

PCT Pub. Date: Sep. 1, 2011

(65) Prior Publication Data

US 2012/0328466 A1 Dec. 27, 2012

(30) Foreign Application Priority Data

Feb. 24, 2010 (JP) ..... 2010-038030

(51) Int. Cl.
*C22C 38/50* (2006.01)
*C22C 38/44* (2006.01)

(Continued)

(52) U.S. Cl.
CPC . *C21D 9/50* (2013.01); *C22C 38/50* (2013.01); *C22C 38/06* (2013.01); *C22C 38/42* (2013.01); *C22C 38/46* (2013.01); *C21D 8/0205* (2013.01); *C22C 38/04* (2013.01); *C21D 2211/008* (2013.01); *C22C 38/02* (2013.01); *C21D 2211/005* (2013.01); *C22C 38/001* (2013.01); *C21D 8/0273* (2013.01)
USPC ..... 148/325; 420/30; 420/61; 420/68; 420/70

(58) Field of Classification Search
None
See application file for complete search history.

(56) References Cited

U.S. PATENT DOCUMENTS 5,985,209 A 11/1999 Kimura et al.
2009/0098009 A1 4/2009 Fukaya et al.

FOREIGN PATENT DOCUMENTS

JP 49-53521 5/1974
JP 51-14811 2/1976

(Continued)

OTHER PUBLICATIONS

Machine English-translation of Japanese patent No. 2007-321245, Inoue Yoshiharu et al., Dec. 13, 2007.*

(Continued)

*Primary Examiner* — Deborah Yee
(74) *Attorney, Agent, or Firm* — Birch, Stewart, Kolasch & Birch, LLP

(57) ABSTRACT

The present invention provides an optimum low-chromium stainless steel which prevents corrosion resistance degradation of a weld in the case of welding a low-chromium stainless steel utilizing martensite transformation in multiple passes (multipass), is excellent in weld intergranular corrosion resistance even in a severe corrosion environment, simultaneously avoids occurrence of preferential corrosion at the bond-bordering region of the weld heat-affected zone, and is also excellent in productivity, which low-chromium stainless steel comprises, in mass %, C: 0.015 to 0.025%, N: 0.008 to 0.014%, Si: 0.2 to 1.0%, Mn: 1.0 to 1.5%, P: 0.04% or less, S: 0.03% or less, Cr: 10 to 13%, Ni 0.2 to 1.5%, and Al: 0.005 to 0.1% or less, and further comprises Ti: 6×(C %+N %) or greater and 0.25% or less, the balance being Fe and unavoidable impurities, and the contents of the elements satisfy specified expressions.

4 Claims, 1 Drawing Sheet

(51) Int. Cl.

| | |
|---|---|
| ***C22C 38/42*** | (2006.01) |
| ***C22C 38/48*** | (2006.01) |
| ***C22C 38/06*** | (2006.01) |
| ***C22C 38/46*** | (2006.01) |
| ***C21D 8/02*** | (2006.01) |
| ***C22C 38/04*** | (2006.01) |
| ***C21D 9/50*** | (2006.01) |
| ***C22C 38/02*** | (2006.01) |
| ***C22C 38/00*** | (2006.01) |

(56) References Cited

FOREIGN PATENT DOCUMENTS

| | | | |
|---|---|---|---|
| JP | 51-13463 | B | 4/1976 |
| JP | 58-174554 | A | 10/1983 |
| JP | 61-23259 | B2 | 6/1986 |
| JP | 9-316611 | A | 12/1997 |
| JP | 2002-53938 | A | 2/2002 |
| JP | 2002-167653 | A | 6/2002 |
| JP | 2002-327251 | A | 11/2002 |
| JP | 3491625 | B2 | 1/2004 |
| JP | 2007-238973 | A | 9/2007 |
| JP | 2009-13431 | A | 1/2009 |
| JP | 2009-280850 | A | 12/2009 |
| WO | WO 2009/119881 | A1 | 10/2009 |

OTHER PUBLICATIONS

Ikawa, H. et al., "Study on Behaviour of Carbides and Knife Line Attack Phenomenon in Stabilized Austenitic Stainless Steels (Report 1)", Journal of the Japan Welding Society, 1975, pp. 679-686, vol. 44, No. 8.

International Search Report issued in PCT/JP2011/054409, mailed May 17, 2011.

Chinese Office Action dated Sep. 13, 2013 issued in corresponding Chinese Patent Application No. 201180008992.7.

* cited by examiner

LOW-CHROMIUM STAINLESS STEEL EXCELLENT IN CORROSION RESISTANCE OF WELD

TECHNICAL FIELD

This invention relates to a low-chromium stainless steel excellent in corrosion resistance of a weld for use in severe corrosion environment applications, which improves intergranular corrosion resistance in the weld heat-affected zone when welded in multiple passes (multipass), further avoids preferential corrosion occurring at the bond-bordering region of a weld heat-affected zone, and is usable as a structural steel or the like over a long period.

BACKGROUND ART

Owing to the fact that chromium stainless steels low in steel chromium content and also low in nickel content are much more advantageous in terms of price than austenitic stainless steels like SUS304 steel, they are suitable for applications like structural steels that are used in large quantities. Depending on the composition, this kind of chromium steel has a ferritic structure or a martensitic structure, but ferritic and martensitic stainless steels are generally poor in low-temperature toughness and corrosion resistance of welds. For example, in the case of a martensitic stainless steel as typified by SUS410, C content is high at around 0.1 mass %, so that toughness of a weld and workability of a weld are poor, and since welding work efficiency is also poor because preheating is necessary when welding, issues remain regarding application to members that require welding.

As a way for preventing such weld property degradation, methods such as set forth in Patent Document 1 and Patent Document 2 have been proposed which utilize martensitic formation at the weld to prevent loss of corrosion resistance and low-temperature toughness. What Patent Document 1 teaches is a method of including Cr: 10 to 18 mass %, Ni: 0.1 to 3.4 mass %, Si: 1.0 mass % or less and Mn: 4.0 mass % or less and further lowering C to 0.030 mass % or less and N to 0.020 mass % or less in order to form massive martensite at weld heat-affected zones, thus proposing a martensitic stainless steel for welded structures that is improved in weld performance.

Low-chromium stainless steels utilizing this kind of martensite transformation at welds is actually used as a frame material of marine containers and no weld corrosion resistance or low-temperature toughness problems have been reported up to now.

However, it has been learned that cases will arise in which corrosion resistance at the welds is inadequate when utilized in a use environment that is a severe corrosion environment (prolonged wetness duration, high chloride concentration, high temperature, low pH, etc.). For example, cases have been reported of intergranular corrosion occurring at weld heat-affected zones when used in the cargo container or the like of a railway freight car for hauling coal or iron ore. This is because a Cr-depletion layer occurring as the result of Cr carbide precipitation under the effect of heat of multiple welding passes corrodes.

As a method for improving the corrosion resistance of the weld heat-affected zone and toughness of the weld of a low-chromium stainless steel, it is effective to increase the purity of a steel like the foregoing to a high level and additionally add elements for fixing carbon and nitrogen as carbides and nitrides, so that various steels produced using these methods have been reported.

For example, Patent Document 3 teaches use of martensite transformation to prevent degradation of chromium steel intergranular corrosion resistance by addition of suitable amounts of the carbon and nitrogen stabilizing elements Nb and Ti, and also teaches a chromium steel excellent in low-temperature toughness. Similarly, Patent Document 4 teaches a Fe—Cr alloy improved in weld corrosion resistance by addition of the carbide-forming elements Ti, Nb, Ta and Zr. However, this Document requires inclusion of Co, V and W and is aimed at improving initial corrosion resistance.

Although the intergranular corrosion resistance of weld heat-affected zones is improved in a martensitic stainless steel to which Ti, Nb and other stabilizing elements are added, there is a problem of preferential corrosion occurring near the interface (bond area) between the weld metal and the adjacent heat-affected zone having a massive martensite structure.

This phenomenon resembles the phenomenon called knife-line attack that, as taught by Non-patent Document 1, is observed in the welds of SUS321 and SUS347 stabilized austenitic steels. This is a problem that should be resolved because the interface (bond area) between the weld metal and the heat-affected zone preferentially corrodes and the corrosion region expands progressively.

The cause of knife-line attack is that during welding of a stainless steel in which C is fixed as TiC or NbC, the TiC and NbC enter into solid solution at regions with a heat history of having risen to about 1200° C. or greater and Cr carbide precipitates at the grain boundaries to lower corrosion resistance when the steel thereafter passes through the sensitizing temperature range in the cooling process. Patent Document 5 therefore teaches low-chromium stainless steel enabling multipass welding that is excellent in corrosion resistance of heat-affected zone and does not sustain occurrence of knife-line attack even after multiple welding passes, and defines γp (gamma potential), an index for evaluating austenite stability, as 80% or greater, Cr: 10 to 15%, Mn: greater than 1.5 to 2.5%, Ni: 0.2 to 1.5%, and Ti: 4×(C %+N %) or greater.

$$\gamma p=420\times Co+470\times N\ \%+23\times Ni\ \%+9\times Cu\ \%+7\times Mn\ \%-11.5\times Cr\ \%-11.5\times Si\ \%-12\times Mo\ \%-23\times V\ \%-47\times Nb\ \%-49\times Ti\ \%-52\times Al\ \%+189\geq 80\%.$$

Further, Patent Document 5 teaches prevention of edge cracking during hot rolling by controlling hot-rolling heating temperature to a temperature at which austenite single phase region or delta ferrite amount becomes greater than 50% and prevention of surface defects owing to TiN crystallization by making Ti×N 0.004 or less.

On the other hand, it is known that the surface of the weld heat-affected zone of a low-chromium stainless steel has a problem of corrosion occurring in a form similar to knife-line attack owing to the fact that the oxide scale forms to a greater thickness than in SUS304, SUS430 and the like, so that a Cr-depletion layer is formed directly under the scale, and in Patent Document 5, not only for intergranular corrosion resistance, but also for preventing preferential corrosion occurrence near the weld fusion line, and Cr content of 11.4% or greater at Mn of 1.5 to 2.5% is considered preferable.

However, a study by the present inventors found that preferential corrosion near the weld bond area cannot be prevented at a Mn content of 1.5% or greater unless Cr amount is controlled to 13% or greater.

Further, it was discovered that the preferential corrosion of the weld heat-affected zone near the bond in the steel under consideration is rarely caused by the sensitization arising just after Ti(CN) solution treatment as generally known to be the cause in austenitic stainless steels but is chiefly due to the aforesaid oxidization.

It was found that increasing the Cr content of the base metal to 13% or greater is effective for inhibiting corrosion of the Cr-depletion layer caused by oxidation during welding and that corrosion similar to knife-line attack cannot be adequately prevented in the Cr content range of 10 to 13% common for martensitic stainless steels. On the other hand, increasing Cr content to 13% or greater is hard because it narrows the austenite single phase temperature range, lowers the toughness of the weld heat-affected zone by δ ferrite, and causes loss of heat-affected zone intergranular corrosion resistance. Therefore, a technology has been desired that improves corrosion resistance at a Cr content of 13% or less by inhibiting weld heat-affected zone scale formation.

PRIOR ART REFERENCES

Patent Documents

Patent Document 1 Examined Patent Publication (Kokoku) No. 51-13463
Patent Document 2 Examined Patent Publication (Kokoku) No. 61-23259
Patent Document 3 Unexamined Patent Publication (Kokai) No. 2002-327251
Patent Document 4 U.S. Pat. No. 3,491,625
Patent Document 5 Unexamined Patent Publication (Kokai) No. 2009-13431

Non-Patent Document

Non-patent Document 1 Journal of the Japan Welding Society, Vol. 44, 1975, No. 8, p 679

DISCLOSURE OF THE INVENTION

Problem to be Solved by the Invention

The object of the present invention is to provide an optimum low-chromium stainless steel that prevents the degradation of corrosion resistance of a weld observed when a low-chromium stainless steel utilizing martensite transformation is welded in multiple passes (multipass), is excellent in multipass weld intergranular corrosion resistance even in a severe corrosion environment such as use in a railway freight car for coal or iron ore, does not sustain occurrence of simultaneous preferential corrosion near the bond area, and is also excellent in productivity.

Means for Solving the Problems

As the result of an assiduous study to resolve the aforesaid issues, the inventors discovered that prevention of weld decay occurrence in the case of multiple welding passes (multipass) can be achieved by adding Ti and Nb to stabilize the carbon and nitrogen that cause intergranular corrosion, but on the other hand that Ti and Nb addition is ineffective for preventing occurrence of preferential corrosion (knife-line attack) of the heat-affected zone adjacent to the bond area.

They therefore conducted a study on prevention of preferential corrosion of the heat-affected zone adjacent to the bond area, which resulted in the findings: that owing to the exposure of the heat-affected zone adjacent to the bond area to extremely high temperatures, thick scale forms, depending on the steel composition, only at this region and Cr concentration declines immediately under the scale to form a so-called Cr-depletion layer; that preferential corrosion resembling knife-line attack occurs as a resulting phenomenon; and that it is effective for scale control either to make Cr 13% or greater or to lower Mn and Ti content.

Specifically, it was discovered that by defining Mn as 1.5% or less and Ti as 0.25% or less, scale growth can be reduced and corrosion due to a Cr-depletion layer immediately under the scale can be inhibited even at a Cr content of 13% or less.

Further, as regards the problem, albeit a rare phenomenon, of knife-line-attack-shaped corrosion occurring as a result of the heat-affected zone in contact with the bond area being sensitized because Ti and other stabilizing elements cannot fix C and N, it was learned that: sensitization must be inhibited by reducing C and N even in a martensitic stainless steel; but that controlling C to 0.015 to 0.025% and N to 0.008 to 0.014% is important because excessively reducing C and N content expands the δ single phase range, thereby coarsening the crystal grains of the HAZ in contact with the bond area and causing loss of toughness.

Further, it became clear that that the product of Ti times N needs to be controlled to 0.003 or less because increasing Ti and N contents causes surface defects owing to TiN crystallization.

In addition, it was discovered that in order to prevent decline of weld toughness in addition to improving weld heat-affected zone corrosion resistance, it is simultaneously necessary to optimize phase stability by designing a composition that satisfies the following Expression (A) denoting austenite stability. Specifically, under conditions of low γp such that δ ferrite forms in the weld heat-affected zone, toughness is lost owing to crystal grain coarsening, and heat-affected zone corrosion resistance is diminished owing to precipitation of carbides at the ferrite grain boundaries during cooling.

$$\gamma p = 420\times C\,\% + 470\times N\,\% + 23\times Ni\,\% + 9\times Cu\,\% + 7\times Mn\,\% - 11.5\times Cr\,\% - 11.5\times Si\,\% - 12\times Mo\,\% - 23\times V\,\% - 47\times Nb\,\% - 49\times Ti\,\% - 52\times Al\,\% + 189 \geq 80\% \quad \text{(A)}$$

γp (gamma potential) is an index for evaluating austenite stability and at the same time is an index expressing ease of martensite formation.

The present invention was realized based on this knowledge and the gist thereof is as set out below.

(1) A low-chromium stainless steel characterized in that it comprises, in mass %, C: 0.015 to 0.025%, N: 0.008 to 0.014%, Si: 0.2 to 1%, Mn: 1.0 to 1.5%, P: 0.04% or less, S: 0.03% or less, Cr: 10 to 13%, Ni 0.2 to 1.5%, and Al: 0.005 to 0.1% or less, and further comprises Ti: 6×(C %+N %) or greater and 0.25% or less, the balance being Fe and unavoidable impurities, and that the contents of the elements satisfy Expression (A) and Expression (B) below:

$$\gamma p\ (\%) = 420\times C\,\% + 470\times N\,\% + 23\times Ni\,\% + 9\times Cu\,\% + 7\times Mn\,\% - 11.5\times Cr\,\% - 11.5\times Si\,\% - 12\times Mo\,\% - 23\times V\,\% - 47\times Nb\,\% - 49\times Ti\,\% - 52\times Al\,\% + 189 \geq 80\% \quad \text{(A)}$$

$$Ti\,\% \times N\,\% < 0.003 \quad \text{(B)}$$

(2) A low-chromium stainless steel as set out in (1), characterized by further comprising, in mass %, one or both of Mo: 0.05 to 2% and Cu: 0.05 to 2%.

(3) A low-chromium stainless steel as set out in (1) or (2), characterized by further comprising, in mass %, one or both of Nb: 0.01 to 0.5% and V: 0.01 to 0.5%.

Effect of the Invention

The present invention can provide a low-chromium stainless steel that does not contain more than required amounts of expensive elements, does not sustain preferential corrosion at the bond-bordering region of a weld heat-affected zone, is excellent in intergranular corrosion resistance of a multipass weld heat-affected zone, and can be used as a structural steel in a severe corrosion environment, and as such is a highly valuable invention for industry.

BRIEF DESCRIPTION OF THE DRAWINGS

FIG. 1(*b*) is a view showing the sectional metallographic structure of a weld heat-affected zone after modified Strauss testing, namely, the sectional structure of the MIG weld heat-affected zone of comparative steel No. a28.

MODES FOR CARRYING OUT THE INVENTION

Figure 1A:
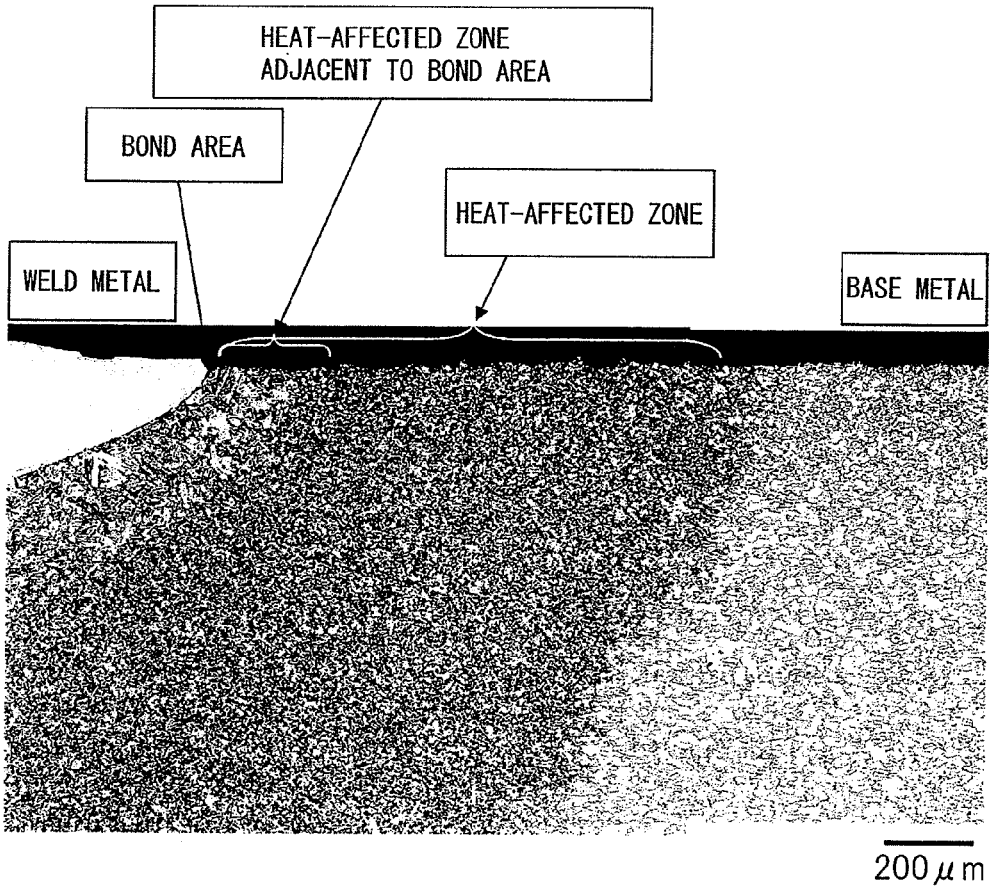
FIG. 1(*a*) is a view showing the sectional metallographic structure of a weld heat-affected zone after modified Strauss testing, namely, the sectional structure of the MIG weld heat-affected zone of invention steel No. A1.

The present invention will be explained in further detail. The reasons for limiting the components will be explained first.

C lowers the toughness of the martensitic structure of a weld and causes decease in intergranular corrosion resistance, so its content is defined as 0.025 mass % or less. However, since C is an element effective for ensuring base metal strength, and the desired material properties as a structural steel cannot be obtained when reduced excessively, the lower limit of content is defined as 0.015%.

N degrades intergranular corrosion resistance by precipitating nitrides and forming a Cr-depletion layer and sometimes also produces surface defects by generating coarse TiN during casting, so the upper limit of content is defined as 0.014 mass % or less. However, within the composition range of the present invention, excessive N reduction not only increases refining load but owing to softening also makes it impossible to obtain the desired material properties as a structural steel, so the lower limit of content is defined as 0.008 mass %.

Si is an element ordinarily used as a deoxidizer but adequate deoxidizing effect cannot be obtained at a content of 0.2 mass % or less, and while it is also sometimes actively added to improve oxidation resistance, content is limited to 0.2 to 1 mass % because it degrades steel productivity at a content exceeding 1 mass %.

Mn is an austenite (γ phase) stabilizing element and effectively contributes to toughness improvement by giving the weld heat-affected zone structure a martensitic structure. Further, like Si, Mn is also usable as a deoxidizer, and is therefore incorporated in the range of 1.0 mass % or greater. However, excessive addition promotes scale formation at the bond-bordering region of a weld heat-affected zone, giving rise to a Cr-depletion layer, whereby preferential corrosion occurring at the bond-bordering region of a weld heat-affected zone degrades corrosion resistance, and the content is therefore limited to 1.5 mass % or less.

P is an element that readily segregates at the grain boundary, and is therefore an element that not only degrades hot workability, formability and toughness but is also harmful with respect to the ordinary corrosion resistance of the base metal (general corrosion, pitting corrosion), and since its effect is particularly pronounced when the content exceeds 0.04 mass %, P content is held to 0.04 mass % or less. It is more preferably 0.025% or less.

S forms sulfidic inclusions, and since it is an element that degrades the ordinary corrosion resistance of the base metal (general corrosion, pitting corrosion), the upper limit of its content must be defined as 0.03 mass %. Although corrosion resistance improves with decreasing S content, the desulfurization load for reducing S is increased, so the lower limit is preferably defined as 0.003 mass % or less.

Cr is an element effective for improving the ordinary corrosion resistance of the base metal (general corrosion, pitting corrosion), but adequate corrosion resistance is hard to ensure at less than 10 massa. When Cr is made 13% or greater, an effect of preventing preferential corrosion at the bond-bordering region of a weld heat-affected zone can also be realized, but Cr is a ferrite phase (α phase) stabilizing element, so that addition in excess of 13 mass % decreases the stability of austenite phase (γ phase), which makes it impossible to ensure an adequate amount of martensite phase during welding and thus leads to degradation of weld strength and toughness. In addition, ferrite occurring in the weld heat-affected zone sometimes leads to loss of weld heat-affected zone intergranular corrosion resistance. Therefore, in the present invention, Cr is incorporated in the range of 10 mass % or greater to 13 mass % or less. Moreover, the range particularly preferable for ensuring ordinary corrosion resistance of the base metal in combination with ordinary weld corrosion resistance and toughness is 11.0 to 12.0 mass %.

Ni is effective for improving ordinary corrosion resistance of the base metal and has an effect of inhibiting pitting corrosion growth. Moreover, since it promotes weld martensite formation and is an indispensable element for weld toughness improvement, its content must be at least 0.2 mass % or greater. However, when its content exceeds 1.5%, the hot-rolled annealed sheet becomes extremely high-strength/low ductility owing to enhanced temper-softening resistance, so 0.2 to 1.5 mass % is incorporated.

Al is an added component effective as a deoxidizer, but when heavily included, degrades steel surface quality and also impairs weldability, so the content thereof is made 0.005 to 0.1 mass % or less. It is preferably 0.005 to 0.03 mass %.

Ti is an indispensable element for preventing intergranular corrosivity of the weld heat-affected zone. A Ti content of at least six times the total of the C and N contents is required, but addition in excess of 0.25 mass % saturates the effect of improving intergranular corrosion resistance and, by fostering weld heat-affected zone scale formation, may reversely cause occurrence of preferential corrosion at the bond-bordering region of a weld heat-affected zone. In addition, by generating coarse TiN during casting and giving rise to pore defects, it causes degradation of other properties, including formation of surface defects during hot rolling and reduction of workability. Therefore, from the aspect of improving the intergranular corrosion resistance of the weld heat-affected zone, the lower limit of Ti content is defined as 6×(C mass %+N mass %), thereby preventing preferential corrosion of the bond-bordering region of a weld heat-affected zone, and further from the viewpoint of preventing surface defects, the upper limit is defined as 0.25 mass %.

Furthermore, in addition to the foregoing component concentration ranges, the component concentrations are stipulated to satisfy Expression (A). Owing to this stipulation, it is possible to obtain a chromium steel excellent in both toughness and intergranular corrosion resistance of the weld.

In mass %, (A)

$$\gamma p = 420\times C\ \% + 470\times N\ \% + 23\times Ni\ \% + 9\times Cu\ \% + 7\times Mn\ \% - 11.5\times Cr\ \% - 11.5\times Si\ \% - 12\times Mo\ \% - 23\times V\ \% - 47\times Nb\ \% - 49\times Ti\ \% - 52\times Al\ \% + 189 \geq 80\%$$

γp of Expression (A) is an index indicating the stability of austenite in a stainless steel and is at the same time an index expressing ease of martensite formation. When γp is 80% or greater, a weld heat-affected zone under cooling passes through the high-temperature austenite single-phase region to be totally transformed to form an adequate martensitic structure in the weld heat-affected zone. On the other hand, when less than 80%, austenite becomes unstable and martensite phase formation is inadequate. Concurrently, it is necessary to satisfy Expression (A) also so that total transformation through the γ phase is achieved during hot rolling to obtain a fine-grained structure after hot-rolled sheet annealing.

Finer ferrite grain diameter is also advantageous for improving intergranular corrosion resistance and improving low-temperature toughness by increasing grain boundary area. Therefore, average grain size is preferably equal to or greater than ferrite grain size No. 6 under JIS G 00522.

It should be noted that although this ferrite grain size number indicates that of the final product, the chromium steel of the present invention is a structural steel required to be low in cost, so that the final product is exclusively hot-rolled annealed steel. By stabilizing austenite to achieve γp of 80 or greater, the phase fractions of δ ferrite and austenite during hot rolling become approximately equal to enable prevention of hot-rolled sheet edge cracking.

Further, the heat-affected zone assumes martensitic structure during welding, so that the weld heat-affected zone exhibits high toughness thanks to the prevention of structure coarsening.

Furthermore, the component concentrations are stipulated to satisfy Expression (B) in addition to the foregoing component concentration ranges and Expression (A). Owing to this stipulation, it is possible to prevent occurrence of hot-rolled sheet surface defects. When Expression (B) is not satisfied and Ti and N contents are high, many coarse TiN crystals form at the liquidus temperature when the molten steel solidifies, and defects attributable to pores that float up late because they adhere to TiN cause surface defects during hot rolling. As stated above, the final product is hot-rolled annealed steel, and since it is frequently used with a pickled surface after descaling, the components also need to be stipulated from the viewpoint of surface defect prevention.

$$Ti\ \% \times N\ \% < 0.003 \quad (B)$$

While the low-chromium stainless steel of the present invention explained above is excellent in weld toughness and intergranular corrosion resistance, addition of Mo or Cu to the steel works effectively to further improve corrosion resistance in solutions of low pH. Cu addition is particularly effective with respect to the dilute sulfuric acid environment of low pH caused by coal leachate in the case of hauling coal. In order to improve corrosion resistance, Mo and Cu respectively need to be added to at least 0.05 mass % or greater, but addition exceeding Mo of 2 mass %, Cu of 2 mass % saturates the corrosion resistance improving effect and causes degradation of workability and the like, so the upper limits are defined as Mo 2 mass %, Cu 2 mass %. They are preferably 0.1 to 1.5 mass % for both Mo and Cu.

Further, since Cu comes after C, N and Ni as a stabilizing element, it is an effective element for controlling the phase stability calculated from γp of Expression (A). And since Cu and Mo are solid solution strengthening elements, they are useful elements in the case of high strengthening.

One or both of Nb and V can be selectively added. Both are carbonitride forming elements, and while in the case of Nb, a content of 0.01 mass % is required for fixing C and N, addition in excess of 0.5 mass % saturates the effect of improving intergranular corrosion resistance and causes degradation of workability and other properties. Therefore, the range is defined as 0.01 to 0.5 mass %. It is preferably 0.03 to 0.3 mass %.

For the same reason, the range of V is defined as 0.01 to 0.5 mass %. It is preferably 0.03 to 0.3 mass %.

Further, Nb acts to enhance the temper-softening resistance of the martensitic structure of the hot-rolled sheet and thus enables a broader application range at the time of hot-rolled sheet temper-annealing in the case of producing a high-strength steel excellent in strength-ductility balance.

Next, an appropriate method of producing the low-chromium stainless steel of the present invention will be explained.

First, molten steel regulated to the aforesaid suitable composition is made using a converter, electric furnace or other ordinary known steelmaking furnace, refining is conducted by vacuum degassing (RH method), VOD method, AOD method or other known refining process, and casting into a slab or the like is done by continuous casting or ingoting-blooming to afford a steel material.

The steel material is then heated and made into a hot-rolled sheet by a hot-rolling process. At this time, the heating temperature in the hot-rolling process is very important from the viewpoint of avoiding hot-rolled sheet edge cracking. In the case of an austenitic stainless steel, where the phase state at the hot rolling stage includes delta ferrite at less than 50%, particularly at 10 to 30%, stress concentrates in the delta phase owing to low deformability, so that that defects like surface cracking, especially edge cracking, readily occur to raise various problems in the aspects of process, yield, and material properties. The present inventors discovered that in the invention steel improved in weld toughness and corrosion resistance, surface cracking and edge cracking are prevented at a heating temperature of 1200 to 1260° C. The preferable range is 1230 to 1250° C.

Further, although the hot-rolling conditions are not particularly specified insofar as the hot-rolled sheet can be given the desired thickness in the hot-rolling process, a hot-roll finishing temperature of 800° C. or greater to 1000° C. or less is preferable in the point of ensuring strength, workability, and ductility. And the coiling temperature when annealing is to be performed as the next process is 800° C. or less, preferably 650° C. to 750° C.

Upon completion of hot rolling, where the structure has become martensite and hard, hot-rolled sheet annealing is preferably conducted for softening by martensite phase tempering. The tempering temperature is preferably as high as possible within the ferrite temperature range. Although the $A_1$ transformation point that is the upper limit temperature of ferrite single phase varies with the amount of added Ni and other elements, it is usually adjusted to around 650 to 700° C. in a practical steel, and annealing at a temperature not higher than this is preferable. Therefore, this hot-rolled sheet annealing is preferably performed at annealing temperature: 650 to 750° C., and holding time: 2 to 20 h from the viewpoint of not only softening but also improving workability and ensuring ductility.

It should be noted that following hot-rolled sheet annealing, it is more preferable from the softening aspect for the cooling in the temperature range of 600 to 750° C. to be performed gradually at a cooling rate of 50° C./h or less. Further, the hot-rolled or hot-rolled annealed steel sheet can as necessary be made into the product sheet in a condition removed of scale by shot blasting, pickling or the like, or after surface-dressing to desired properties by polishing, skin pass or the like. Further, the steel of the composition according to the present invention can be applied to various steels usable as structural steels in fields including steel plates, steel shapes produced by hot rolling, and steel bars.

EXAMPLES

The present invention is concretely explained below with examples. Table 1 and Table 2 show invention examples and comparative examples related to the problem at hand. Table 1 shows the compositions in the steels of invention steels and comparative steels expressed in mass %. Steels No. A1 to A20 are invention steels, and steels No. a21 to a30 are comparative steels. Slabs of the compositions shown in Table 1 were cast into 40 kg or 35 kg ingots by the vacuum-melting method. Following steel surface cleaning, the ingots were heated at 1200 to 1260° C. for 1 hour and subjected to hot rough rolling consisting of multiple passes and ensuing hot finish rolling. The hot rolling finishing temperature was 800 to 950° C. After air cooling, the hot-rolled sheets were held for 1 hour at a coiling temperature of 700° C., and then air cooled and subjected to simulated coil heat treatment to obtain 4-mm thick hot-rolled sheets. Next, in order to determine the annealing temperature of the hot-rolled sheets, the hot-rolled sheets of the respective composition values were heat treated at 675° C. for 5 hours followed by furnace cooling. Finally, descaling by shot blasting and pickling was performed to afford hot-rolled sheets.

The test methods for evaluating various properties are explained below.

<Chemical Composition>

For the components, a specimen was sampled from the steel sheet and component analysis conducted. For C, S and N, gas chromatography was used (N by inert gas fusion—thermal conduction measurement method; C and S by combustion in oxygen steam—infrared absorption method), and for other elements an X-ray Fluorescence Spectrometer (SHIMADZU, MXF-2100) was used.

<Productivity>

Presence/absence of hot-rolled sheet edge cracking was assessed by external observation of the hot-rolled sheet edges for presence of cracks. Absence of cracks was rated as G (Good), presence of cracks that did not pass through from the front to rear surface was rated as F (Fair), and presence of cracks that passed through from the front to rear surface was rated as P (Poor). Occurrence or not of scab flaws, one kind of hot-rolled sheet surface defect, was assessed by external observation of the hot-rolled sheet surfaces for presence of flaws. Absence of flaws was rated as G and presence of flaws as P.

<Mechanical Properties>

0.2% proof stress and elongation were tested by preparing a JIS Z 2201 No. 13B test piece from the hot-rolled annealed sheet and testing by the test method of JIS Z 2241 using an Instron-type tensile testing machine. L-direction (parallel to rolling direction) data was measured at n=2. G and P in the table indicate 0.2% proof stress of 320 MPa or greater as G (Good) and of less than 320 MPa as P (Poor). Further, elongation of 20% or greater was rated as G (Good) and of less than 20% as P (Poor). Charpy testing was performed for impact properties. A JIS No. 4 2-mm sub-size V-notch (4 mm thick) specimen in compliance with the JIS standard was taken from a MIG weld and impact-tested at 20° C. The V-notch was cut in the bond region to be half in the weld metal and half in the base metal. An impact value of 30 J/cm$^2$ or more was rated as G (Good) and of less than 30 J/cm$^2$ as P (Poor).

<Base Metal Corrosion Properties>

The sulfuric acid immersion test method is explained hereafter. A 2 mm×25 mm×25 mm corrosion test specimen was prepared from the hot-rolled, annealed and pickled sheet. Sulfuric acid solution (pH=2) was used as the corrosive solution. The amount of the solution was 500 mL per specimen. The test temperature was 30° C. A corrosion rate of 3 g/m$^2$/h or less was rated as G (Good) and, particularly, if less than 2 g/m$^2$/h as E (Excellent), and of greater than 3 g/m$^2$/h as P (Poor).

<Welding Method>

MIG welding was performed as follows. As the sample for the corrosion resistance evaluation test was used one cruciform-welded by MIG welding. 309 LSi steel (C: 0.017%, Si: 0.74%, Mn: 1.55%, P: 0.024%, S: 0.001%, Ni: 13.68%, Cr: 23.22%) was welded under conditions of voltage: 25 to 30 V, current: 230 to 250 A, and shield gas: 98% Ar+2% $O_2$. A Daihen turbo-pulse welding machine was used. The sheet thickness was 4 mm, and after butt-welding, cruciform welding was performed by bead-on-plate welding in crossing directions. The butt-welding was done under conditions for thorough uranami melt-through. The butt-welded joint was given a V bevel of 90° with a 2-mm root face (gap: 0) and the heat input Q was about 12500 J/cm, and in the case of cruciform welding, a seam weld was welded at Q of about 5600 J/cm after removal to a remaining thickness of about 1 mm.

<Heat-Affected Zone Corrosion Properties>

The generally used intergranular corrosion test is basically the sulfuric acid-copper sulfate test (G0575) (Strauss test) standardized by JIS, which is a suitable test with respect to SUS304 and other high-chromium stainless steels. However, the corrosivity is too severe for a stainless steel whose steel chrome content is low (stainless steel of low chromium of around 12%), so the test was carried out by an evaluation method suitable for a low-chromium stainless steel. Specifically, a 24-hour immersion test (modified Strauss test) was conducted with a solution (boiling) whose sulfuric acid concentration had been lowered to 0.5%.

Figure 1B:
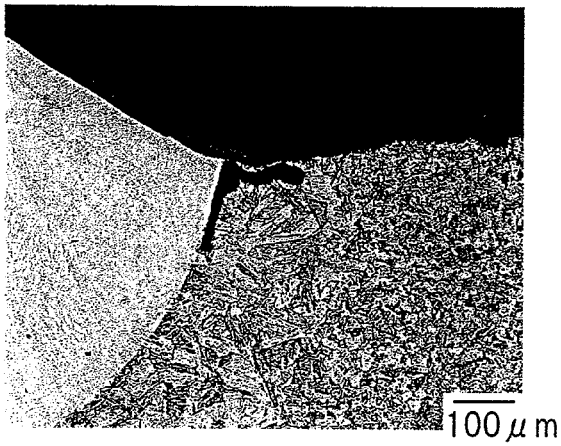

A test was conducted in compliance with JIS except for being lowered in sulfuric acid concentration, and presence/absence of intergranular corrosion was evaluated by observing the metallographic structure of a cross-section. The base metal and weld heat-affected zone were observed, and non-occurrence of intergranular corrosion was rated as G (Good) and occurrence as P (Poor). Further, total non-occurrence of preferential corrosion at the bond-bordering region of the weld heat-affected zone was rated as G (Good) and occurrence at some or all among multiple observation regions as P (Poor). It should noted that eight regions were observed. FIG. 1(*a*) and FIG. 1(*b*) are views showing the sectional metallographic structure of weld heat-affected zones after modified Strauss testing, namely, FIG. 1(*a*) to FIG. 1(*b*) respectively show the sectional structure of the MIG weld heat-affected zone of invention steel No. A1 in FIG. 1(*a*) and the sectional structure of the MIG weld heat-affected zone of comparative steel No. a28 in FIG. 1(*b*).

Two different types of weld heat-affected zones were formed at the weld in addition to at the weld metal crown. These were a weld heat-affected zone adjacent to the bond area and a neighboring weld heat-affected zone. The region adjacent to the bond was characterized in the point that the martensite structure was coarser than at the more distant region. In the photo of FIG. 1(*a*), no corrosion is observed in the weld heat-affected zone adjacent to the bond, while in the photo of FIG. 1(*b*), corrosion is observed at the surface and bond area.

The evaluation results for the properties of the invention examples and the comparative examples are shown in Table 2. No. A1 to A20 are invention examples, and No. a21 to a30 are comparative examples. The invention steels had excellent weld corrosion resistance, with no occurrence of intergranular corrosion at the weld heat-affected zone of multiple welding passes or preferential corrosion at the heat-affected zone in contact with the weld bond area, and were also excellent in weld impact property. In addition, the strength and ductility material properties were also good, and sulfuric acid resistance could also be dramatically improved by selectively adding the elements. Moreover, by improvising the composition design and production conditions of the steel, it was possible to achieve steels excellent in productivity that were free of hot-rolled sheet edge cracking and surface defects.

Since the Cr and Ni contents of comparative example No. a21 were outside the invention ranges, it was inferior in base metal corrosion resistance and weld heat-affected zone impact property. Comparative example No. a22 was low in strength and poor in steel material property because C content was outside the invention range. Comparative example No. a23 was poor in material properties, namely, high in strength and low in ductility, because Cu content was beyond the upper limit of the invention range and Si content was beyond the lower limit of the invention. In addition, deoxidation by Si was insufficient, so that Ti yield was poor. Comparative example No. a24 sustained surface defects in hot rolling because Ti content and the product of Ti content times N content were beyond the upper limits of the invention ranges. Further, edge cracking occurred in hot rolling because Mn content and γp were beyond the lower limits of the invention ranges. Comparative example No. a25 sustained edge cracking because γp was outside the invention range owing to Cr content beyond the upper limit of the invention range. Further, the impact property of the weld heat-affected zone was inferior. Comparative example No. a26 was poor in the corrosion resistance of the bond-bordering region of the weld heat-affected zone because Mn content was beyond the upper limit of the invention range. Further, material property (0.2 proof stress) was poor because N content was beyond the lower limit of the invention range.

Comparative example No. a27 became high in strength and degraded elongation because C and Ni contents beyond the upper limits of the invention ranges, and was poor in the intergranular corrosivity of the weld heat-affected zone because Ti/(C+N) was beyond the lower limit of the present invention. Comparative example No. a28 was poor in corrosion resistance in the bond-bordering region of the weld heat-affected zone because Mn content was beyond the upper limit of the invention range. Comparative example No. a29 was poor in the intergranular corrosion resistance of the weld heat-affected zone because Ti/(C+N) was beyond the lower limit of the present invention owing to Ti content beyond the lower limit of the present invention. Comparative example No. a30 sustained edge cracking and occurrence of surface defects because γp, and the product of Ti content times N content, were outside the invention range. Further, the impact property of the weld heat-affected zone was poor.

TABLE 1

| | Steel No. | C | Si | Mn | P | S | Cr | Ni | Ti | Cu | N | Nb | Al | Mo | V | Ti/(C + N) | γp (%) | Ti × N |
|---|---|---|---|---|---|---|---|---|---|---|---|---|---|---|---|---|---|---|
| Invention | A1 | 0.022 | 0.55 | 1.33 | 0.002 | 0.001 | 11.3 | 0.83 | 0.23 | | 0.011 | | 0.036 | | | 7.1 | 82.0 | 0.0025 |
| | A2 | 0.018 | 0.49 | 1.33 | 0.040 | 0.011 | 11.4 | 1.00 | 0.21 | | 0.010 | | 0.009 | | | 7.5 | 85.9 | 0.0021 |
| | A3 | 0.018 | 0.49 | 1.00 | 0.032 | 0.008 | 10.9 | 0.82 | 0.22 | | 0.010 | | 0.005 | | | 7.9 | 85.5 | 0.0022 |
| | A4 | 0.015 | 0.49 | 1.35 | 0.031 | 0.030 | 11.3 | 0.92 | 0.14 | | 0.008 | | 0.039 | | | 6.0 | 84.7 | 0.0011 |
| | A5 | 0.019 | 0.60 | 1.34 | 0.025 | 0.029 | 10.0 | 0.94 | 0.19 | | 0.009 | | 0.028 | | | 6.8 | 99.5 | 0.0018 |
| | A6 | 0.022 | 0.30 | 1.34 | 0.004 | 0.007 | 11.3 | 0.92 | 0.18 | | 0.008 | | 0.077 | | 0.30 | 6.0 | 80.0 | 0.0015 |
| | A7 | 0.021 | 0.50 | 1.30 | 0.017 | 0.000 | 11.5 | 1.50 | 0.20 | 0.05 | 0.010 | 0.30 | 0.076 | | | 6.2 | 81.5 | 0.0020 |
| | A8 | 0.018 | 0.55 | 1.33 | 0.009 | 0.015 | 11.1 | 0.85 | 0.19 | | 0.008 | | 0.085 | 0.05 | | 7.1 | 80.9 | 0.0015 |
| | A9 | 0.024 | 0.33 | 1.34 | 0.031 | 0.018 | 11.4 | 0.85 | 0.23 | | 0.009 | | 0.015 | | | 6.9 | 85.5 | 0.0021 |
| | A10 | 0.019 | 0.36 | 1.33 | 0.037 | 0.026 | 10.9 | 0.99 | 0.24 | | 0.011 | | 0.027 | | | 8.2 | 91.1 | 0.0026 |
| | A11 | 0.019 | 0.40 | 1.30 | 0.004 | 0.007 | 11.1 | 0.90 | 0.23 | | 0.010 | 0.01 | 0.021 | | | 7.9 | 86.1 | 0.0023 |
| | A12 | 0.025 | 0.60 | 1.34 | 0.031 | 0.015 | 11.3 | 0.81 | 0.22 | | 0.010 | | 0.013 | | | 6.2 | 84.0 | 0.0022 |
| | A13 | 0.022 | 0.31 | 1.31 | 0.031 | 0.008 | 11.0 | 1.50 | 0.23 | | 0.010 | | 0.006 | 2.00 | | 7.2 | 80.8 | 0.0024 |
| | A14 | 0.015 | 0.52 | 1.30 | 0.034 | 0.015 | 11.0 | 1.10 | 0.23 | | 0.011 | | 0.100 | | | 8.6 | 86.7 | 0.0025 |
| | A15 | 0.022 | 0.47 | 1.30 | 0.011 | 0.015 | 11.0 | 0.86 | 0.22 | | 0.010 | | 0.099 | | 0.10 | 6.7 | 81.5 | 0.0022 |
| | A16 | 0.025 | 0.20 | 1.50 | 0.038 | 0.028 | 13.0 | 0.92 | 0.23 | 2.00 | 0.012 | | 0.091 | | | 6.3 | 86.8 | 0.0028 |
| | A17 | 0.018 | 0.40 | 1.50 | 0.019 | 0.025 | 11.1 | 0.20 | 0.18 | 1.00 | 0.011 | | 0.080 | | | 6.3 | 80.5 | 0.002 |
| | A18 | 0.019 | 0.58 | 1.33 | 0.022 | 0.003 | 11.5 | 0.87 | 0.18 | | 0.011 | | 0.046 | | 0.05 | 6.1 | 80.1 | 0.0019 |
| | A19 | 0.025 | 1.00 | 1.50 | 0.027 | 0.013 | 11.2 | 0.99 | 0.25 | 1.00 | 0.011 | | 0.095 | | | 6.8 | 89.8 | 0.0028 |
| | A20 | 0.021 | 0.38 | 1.34 | 0.004 | 0.019 | 11.2 | 0.89 | 0.24 | | 0.008 | | 0.088 | | | 8.2 | 81.7 | 0.002 |
| Comparative | a21 | 0.021 | 0.35 | 1.35 | 0.023 | 0.024 | 9.5 | 0.10 | 0.20 | | 0.011 | | 0.091 | | | 6.2 | 87.1 | 0.0023 |
| | a22 | 0.014 | 0.64 | 1.31 | 0.039 | 0.016 | 11.0 | 0.91 | 0.25 | | 0.012 | | 0.040 | | | 9.7 | 82.2 | 0.0028 |
| | a23 | 0.017 | 0.10 | 1.32 | 0.021 | 0.001 | 11.1 | 0.95 | 0.23 | 3.00 | 0.011 | 0.15 | 0.068 | | | 8.4 | 108.1 | 0.0026 |
| | a24 | 0.018 | 0.61 | 0.80 | 0.038 | 0.017 | 11.2 | 0.90 | 0.26 | | 0.013 | | 0.039 | | | 8.4 | 78.3 | 0.0034 |
| | a25 | 0.022 | 0.53 | 1.34 | 0.026 | 0.008 | 13.2 | 0.89 | 0.23 | | 0.011 | | 0.076 | | | 6.8 | 60.5 | 0.0026 |
| | a26 | 0.024 | 0.61 | 1.60 | 0.033 | 0.019 | 11.4 | 0.85 | 0.21 | 0.50 | 0.007 | | 0.087 | | | 6.8 | 85.0 | 0.0015 |
| | a27 | 0.026 | 0.57 | 1.33 | 0.009 | 0.028 | 11.1 | 1.60 | 0.20 | | 0.011 | | 0.036 | | | 5.4 | 105.7 | 0.0021 |
| | a28 | 0.025 | 0.44 | 1.80 | 0.013 | 0.013 | 11.4 | 0.94 | 0.24 | | 0.012 | | 0.053 | | | 6.6 | 89.0 | 0.0028 |
| | a29 | 0.022 | 0.65 | 1.33 | 0.015 | 0.002 | 11.1 | 0.83 | 0.12 | | 0.011 | | 0.046 | | | 3.6 | 88.7 | 0.0014 |
| | a30 | 0.021 | 0.49 | 1.32 | 0.004 | 0.014 | 11.8 | 0.90 | 0.23 | | 0.014 | | 0.092 | | | 6.5 | 77.1 | 0.0032 |

γp (%) = 420[C] + 470[N] + 23[Ni] + 9[Cu] + 7[Mn] − 11.5[Cr] − 11.5[Si] − 12[Mo] − 23[V] − 47[Nb] − 49[Ti] − 52[Al] + 189

Underlining indicates outside present invention range

TABLE 2

| | | | | | | | | $H_2SO_4$ immersion test | MIG weld HAZ characteristics | | | | |
|---|---|---|---|---|---|---|---|---|---|---|---|---|---|
| | | | Hot-rolling heating | Productivity | | Properties (tensile test) | | | Modified Strauss test | | | | |
| | | | | | | 0.2 | | Base metal | Butt weld | | Cross fillet weld | | Charpy test |
| | No. | Steel No. | temp (° C.) | Edge cracking | Surface defects | proof stress | Elon-gation | General corrosion | Inter-granular corrosion | Prefer-ential corrosion | Inter-granular corrosion | Prefer-ential corrosion | Impact test |
| Invention | 1 | A1 | 1240 | G | G | G | G | G | G | G | G | G | G |
| | 2 | A2 | 1200 | G | G | G | G | G | G | G | G | G | G |
| | 3 | A3 | 1240 | G | G | G | G | G | G | G | G | G | G |
| | 4 | A4 | 1240 | G | G | G | G | G | G | G | G | G | G |
| | 5 | A5 | 1245 | G | G | G | G | G | G | G | G | G | G |
| | 6 | A6 | 1220 | G | G | G | G | G | G | G | G | G | G |
| | 7 | A7 | 1240 | G | G | G | G | E | G | G | G | G | G |
| | 8 | A8 | 1240 | G | G | G | G | E | G | G | G | G | G |
| | 9 | A9 | 1230 | G | G | G | G | G | G | G | G | G | G |
| | 10 | A10 | 1240 | G | G | G | G | G | G | G | G | G | G |
| | 11 | A11 | 1240 | G | G | G | G | G | G | G | G | G | G |
| | 12 | A12 | 1240 | G | G | G | G | G | G | G | G | G | G |
| | 13 | A13 | 1220 | G | G | G | G | G | G | G | G | G | G |
| | 14 | A14 | 1250 | G | G | G | G | G | G | G | G | G | G |
| | 15 | A15 | 1200 | G | G | G | G | G | G | G | G | G | G |
| | 16 | A16 | 1240 | G | G | G | G | E | G | G | G | G | G |
| | 17 | A17 | 1240 | G | G | G | G | G | G | G | G | G | G |
| | 18 | A18 | 1260 | G | G | G | G | G | G | G | G | G | G |
| | 19 | A19 | 1240 | G | G | G | G | E | G | G | G | G | G |
| | 20 | A20 | 1240 | G | G | G | G | G | G | G | G | G | G |
| Comparative | 21 | a21 | 1240 | G | G | G | G | P | G | G | G | G | P |
| | 22 | a22 | 1260 | G | G | P | G | G | G | G | G | G | G |
| | 23 | a23 | 1240 | G | G | G | P | E | G | G | G | G | G |
| | 24 | a24 | 1210 | P | P | G | G | G | G | G | G | G | G |
| | 25 | a25 | 1240 | P | G | G | G | G | G | G | G | G | P |
| | 26 | a26 | 1240 | G | G | P | G | E | G | P | G | P | G |
| | 27 | a27 | 1230 | G | G | G | P | G | P | G | P | G | G |
| | 28 | a28 | 1160 | F | G | G | G | G | G | P | G | P | G |
| | 29 | a29 | 1240 | G | G | G | G | G | P | G | P | G | G |
| | 30 | a30 | 1240 | P | P | G | G | G | G | G | G | G | P |

E: Excellent F: Fair G: Good P: Poor

The invention claimed is:

1. A low-chromium stainless steel characterized in that it comprises, in mass %, C: 0.015 to 0.025%, N: 0.008 to 0.014%, C+N: 0.023 to 0.039%, Si: 0.2 to 1.0%, Mn: 1.0 to 1.5%, P: 0.04% or less, S: 0.03% or less, Cr: 10 to 13%, Ni: 0.2 to 1.5%, and Al: 0.005 to 0.1% or less; and further comprises Ti: 6×(C %+N %) or greater and 0.25% or less, the balance being Fe and unavoidable impurities; and that the contents of the elements satisfy Expression (A) and Expression (B):

$$\gamma p(\%)=420\times C\ \%+470\times N\ \%+23\times Ni\ \%+9\times Cu\ \%+7\times Mn\ \%-11.5\times Cr\ \%-11.5\times Si\ \%-12\times Mo\ \%-23\times V\ \%-47\times Nb\ \%-49\times Ti\ \%-52\times Al\ \%+189\geq 80\% \quad (A)$$

$$Ti\ \%\times N\ \%<0.003 \quad (B).$$

2. A low-chromium stainless steel as set out in claim 1, characterized by further comprising, in mass %, one or both of Mo: 0.05 to 2% and Cu: 0.05 to 2%.

3. A low-chromium stainless steel as set out in claim 1, characterized by further comprising, in mass %, one or both of Nb: 0.01 to 0.5% and V: 0.01 to 0.5%.

4. A low-chromium stainless steel as set out in claim 2, characterized by further comprising, in mass %, one or both of Nb: 0.01 to 0.5% and V: 0.01 to 0.5%.

* * * * *